United States Patent [19]

Saunders

[11] 4,052,866

[45] Oct. 11, 1977

[54] HIGH-RECOVERY FORCE WARP KNIT STRETCH FABRIC WITH LENGTHWISE STABILIZATION

[75] Inventor: Linda Anne Saunders, Newark, Del.

[73] Assignee: E. I. Du Pont de Nemours and Company, Wilmington, Del.

[21] Appl. No.: 727,361

[22] Filed: Sept. 27, 1976

[51] Int. Cl.[2] ..... D04B 23/08; D04B 23/10

[52] U.S. Cl. ..... 66/193; 66/202

[58] Field of Search ..... 66/190–195, 66/169, 170, 202

[56] References Cited

U.S. PATENT DOCUMENTS

| | | | |
|---|---|---|---|
| 2,150,133 | 3/1939 | Seidel | 66/193 |
| 3,178,910 | 4/1965 | Hammerle | 66/170 |
| 3,180,115 | 4/1965 | Marshall | 66/170 |
| 3,567,562 | 3/1971 | Gordon et al. | 66/169 X |
| 3,881,473 | 5/1975 | Corui | 128/90 X |

*Primary Examiner*—Ronald Feldbaum

[57] ABSTRACT

A fabric having unidirectional stretch and recovery force properties suitable for providing the force for dispensing fluid from a container is provided in a fabric construction comprising chain stitches of inelastic yarn, elastomer yarn laid into each course of the fabric providing it with the unidirectional stretch, and substantially inextensible yarn laid lengthwise in said chain stitches to limit the stretch of the fabric in the direction of the chain stitches.

5 Claims, 4 Drawing Figures

HIGH-RECOVERY FORCE WARP KNIT STRETCH FABRIC WITH LENGTHWISE STABILIZATION

BACKGROUND OF THE INVENTION

This invention relates to fabric suitable for use as the force for dispensing fluid from a fluid dispensing container.

U.S. patent application Ser. No. 626,964, filed Oct. 29, 1975, discloses the concept of a stretchable fabric having a unidirectional recovery force useful in supplying the aforesaid dispensing force and various fabric constructions for accomplishing this purpose. Among these fabric constructions is a warp-knit fabric of chain stitches of a nonstretch (inelastic) yearn and elastomer yarn laid into each course of the chain stitches to provide the fabric with stretchability and recovery in the elastomer yarn direction. The denier of the elastomer yarn is chosen to supply the recovery force desired for the fabric. Unfortunately, the recovery force of the fabric is less than expected from the amount of the elastomer yarn in the fabric. One solution to this problem is to increase the amount of elastomer yarn in order to reach the fabric recovery force desired, but this approach undesirably increases the expense of the fabric and may exceed the capability of the knitting machine to form the fabric.

SUMMARY OF THE INVENTION

It has been discovered that one source of the inefficiency of the elastomer yarn to impart its entire recovery force to that of the specific fabric construction described above is due to the stretching of the fabric in the direction of the chain stitches when the fabric is stretched in the elastomer yarn direction. The aforesaid patent application discloses that the fabric stretches much less in the inelastic yarn direction or not at all as compared to the stetchability in the elastomer yarn direction. In fact, the specific fabric construction described above has virtually no stretchability in the inelastic yarn (chain stitch) direction in the relaxed state. When the fabric is stretched in the elastomer yarn direction, however, it has been found that not only does the fabric stretch sufficiently in the chain stitch direction to permit the fabric to expand and bow outwardly in the elastomer yarn direction when the dispensing container is being filled with fluid, the fabric stretches further in the chain stitch direction to yield an actually longer fabric. This fabric lengthening decreases the amount of elastomer yarn present per unit length in the chain stitch direction. For example, 30,000 denier of elastomer yarn per cm of fabric in the chain stitch direction becomes only 20,000 denier per cm upon a 50% lengthening of the fabric.

The fabric of the present invention minimizes the inefficient utilization of the elastomer yarn. More particularly, the fabric of the present invention is a warp-knit fabric comprising chain stitches of inelastic yarn, elastomer yarn laid into each course of said chain stitches to provide said fabric with unidirectional stretch and recovery force, and substantially inextensible yarn laid lengthwise in said chain stitches to limit the stretch of said fabric in the direction of said chain stitches upon the stretch of said fabric in the elastomer yarn direction. The reduction in stretchability of the fabric in the chain stitch (lengthwise) direction provided by the inextensible laid-in yarn greatly improves the recovery force efficiency of the fabric.

DETAILED DESCRIPTION OF THE INVENTION

Figure 1:
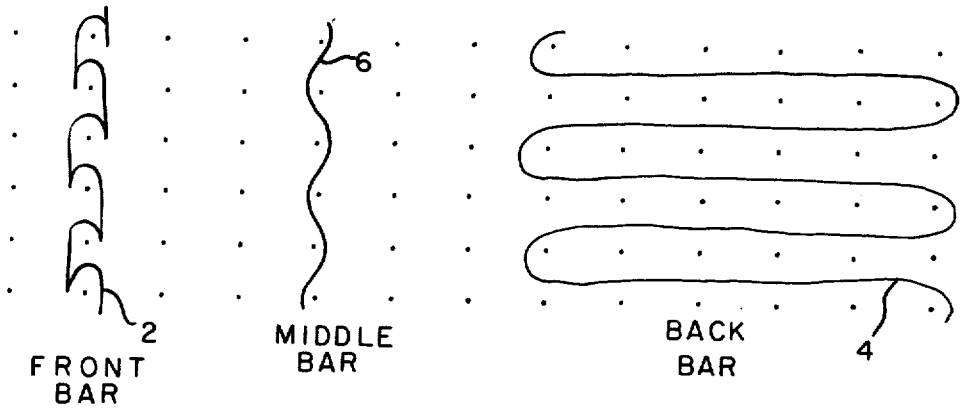
FIG. 1 shows the guide bar motions according to the conventional point diagram for knitting one embodiment of fabric of the present invention.
Figure 4:
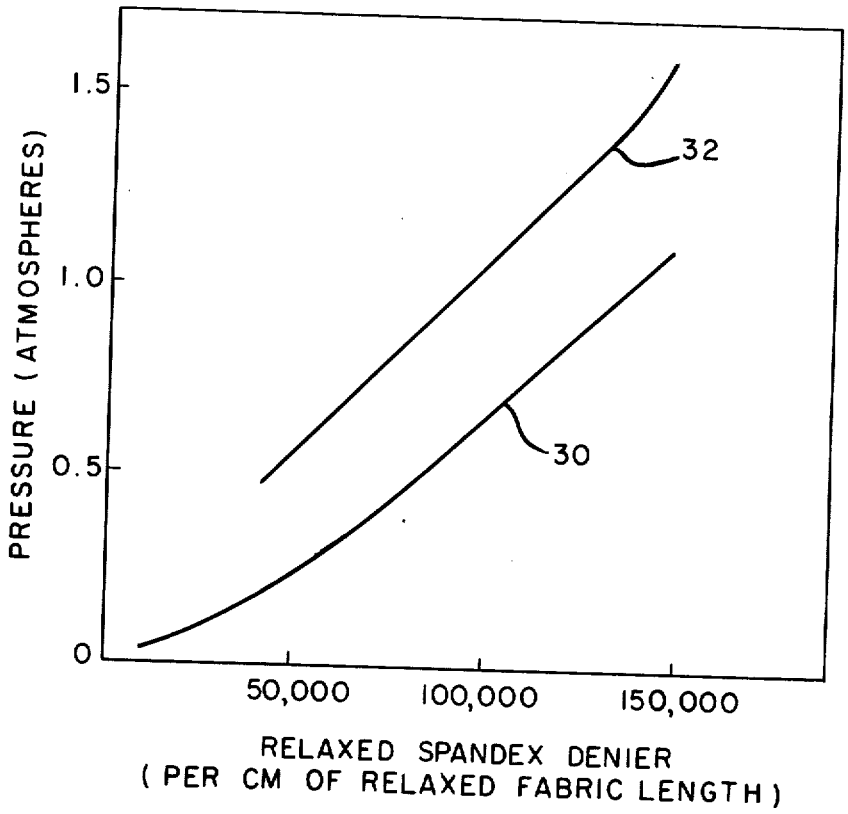
FIG. 4 is a graph of pressure exerted by prior fabrics and fabrics of the present invention vs. the denier of elastomer yarn present in each of the fabrics.

FIG. 1 shows a knitting motion of one embodiment of chain stitch of inelastic yarn 2 and lay in motion for elastomer yarn 4. In making this fabric, the front guide bar of the knitting machine is fully threaded with inelastic yarn, whereas the back guide bar is threaded with elastomer yarn in only one guide which is shogged across the entire width of the fabric. The relationship of these yarns is the same as shown in FIGS. 4 and 5 of the aforesaid patent application, i.e., the chain stitches of yarn 2 form loops around the elastomer yarn 4 and these loops get smaller when the elastomer yarn is stretched and decreases in diameter. Apparently, as the loops of yarn 2 get smaller, more of the inelastic yarn is available for lengthening the wale line of chain stitches, leading to the excessive lengthening hereinbefore described.

In accordance with the present invention, an additional yarn 6 which is inextensible is laid into the chain stitches of yarn 2 by means of a fully threaded middle guide bar as shown in FIG. 1.

Figure 2:
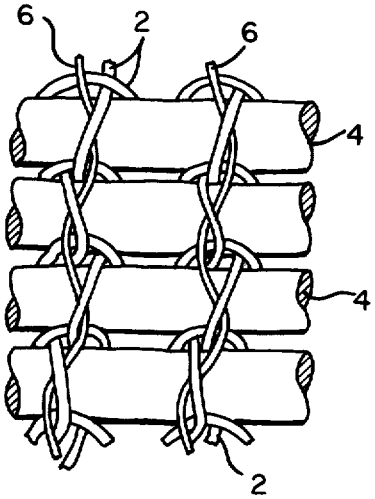
FIG. 2 is an enlarged plan view of a portion of the technical back of the fabric of FIG. 1.

FIG. 2 shows the relationship of yarns 2, 4, and 6 in the resultant fabric. The laid-in yarn 6 passes between the elastomer yarn 4 and the underlap portion of yarn 2 in the chain stitches. This disposition of the laid-in yarn 6 in a virtually straight line along the wale prevents the chain stitch of yarn 2 from lengthening more than an insubstantial amount when the diameter of the elastomer yarn 4 is decreased by stretching.

Figure 3:
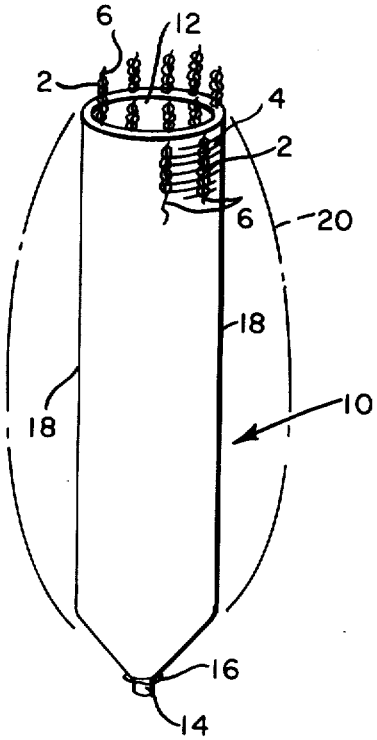
FIG. 3 is a schematic perspective view of fabric of the present invention formed into a tubular shape.

The solution to the problem of fabric recovery force inefficiency is not merely a matter of providing an additional inextensible yarn having a shorter yarn path, however, as will be explained with reference to FIG. 3. The fabric of the present invention is preferably in a tubular shape 10, such as shown in FIG. 3. The tubular shape 10 is open at the top 12 to receive a volume-expansible member (not shown), which in turn receives fluid to be dispensed. The bottom 14 of the tubular shape is constricted, such as by staple 16, to act as a bottom for the volume-expansible member. The elastomer yarn 4 is disposed circumferentially about the tubular shape, whereby the tubular shape is radially expansible. The chain stitches of yarn 2 and the inextensible yarn 6 run along the length of the tubular shape. Ends of yarns 2 and 6 extends from the top of the tubular shape, which can be of assistance in mounting the tubular shape within a dispensing container. The tubular shape can be made from one or two flat pieces of warp-knit fabric and then sewn into the tubular shape along their respective edge or edges 18 as the case may be or may be knit directly on a double-bed Raschel knitting machine.

The tubular shape 10 is shown in the relaxed state in the solid outline in FIG. 3 and in the radially expanded shaped outlined in phantom lines 20 in FIG. 3. The radially expanded state is obtained by filling the volume-expansible member within the tubular shaped with fluid under pressure, which causes the fabric to circumferentially stretch. The yarn 6 must permit the tubular shape to bow out into the expanded shape such as shown in FIG. 3. Surprisingly, despite the rather straight laid-in path of yarn 6, this yarn does not prevent the expanded shape from being reached. At the same time, yarn 6 does prevent any appreciable lengthening of the tubular shape 20, which the fluid-filling step tends to cause.

If the volume-expansible member is a stretchable material, then it will lengthen with any increase in length of the tubular shape and the result of this will only be loss of recovery force from the lengthened tubular shape. If, however, the volume-expansible member is virtually non-stretchable, the lengthening of the tubular shape would leave the bottom of the volume-expansible member unsupported, which could lead to its bursting.

While the chain stitches of yarn 2 do not alone prevent the tubular shape from undesirable lengthening, the chain stitches are important in engaging the elastomer yarn sufficiently to maintain the fabric position of the elastomer yarn so that the volume-expansible member does not blow out through the fabric during expansion.

The yarn forming the chain stitches can be any conventional inelastic yarn. Preferably, such yarn is a flat yarn, i.e., non-textured, or if textured, the texturing is such that the yarn is substantially inextensible, for example, Taslan® yarns. Such inelastic yarns have an elongation at break of less than 50%. The same is true for the additional, substantially inextensible yarn. These yarns can be of continuous filament or staple fiber of such materials as cotton, nylon, acrylic, rayon, and polyester. The additional, substantially inextensible yarn should have a textile modulus of at least 15 g per denier, preferably at least 50 g per denier, and must be strong enough to withstand the pressure built up in the fluid during the filling operation. The term "textile modulus" is used above according to the definition in ASTM Standards D123-75. It is the ratio of change in stress to change in strain in the initial straight line portion of the stress-strain curve after the removal of any crimp, the strain being expressed as a percentage elongation. The value of the modulus then equals 100 times (stress/strain).

The elastomer yarn is preferably bare and has an elongation at break of at least 300% and recovery force at 100% elongation of at least 0.01 g per denier and preferably at least 0.02 g per denier, measured as described in the aforesaid patent application. This yarn can be made of such materials as natural or synthetic rubber or segmented polyurethane, also known as spandex. The elastomer yarn is of high denier, generally at least 8,000 denier and preferably at least 12,000 denier. The elastomer yarn can be single, plied, or coalesced monofilament or multifilament yarn.

With respect to the fabric, the chain stitch can be varied from the open chain stitch 2-0/0-2 (Raschel knitters' notation) and repeat, as shown in FIG. 1, to the closed chain stitch 2-0/2-0 and repeat, or to combinations thereof. The lay-in of elastomer yarn in each course can be varied as desired across the full width or portions thereof. The lay-in of the inextensible yarn into the chain stitch can be varied so as to shog in phase (parallel) or out of phase (opposed) to the underlap of the inelastic yarn in the chain stitch. The out-of-phase embodiment is illustrated in FIG. 2. This inextensible yarn can also be knitted into the chain stitch occasionally or may be floated for one or more courses on the face of the fabric without being laid in the chain stitches.

The elastomer yarn is the main component of the fabric, constituting from 65 to 98%, preferably 75 to 95%, of its weight. The chain stitches and inextensible yarn laid into the chain stitches are present in a relatively minor proportion to perform the engagement and length-stabilizing functions. Thus, while the elastomer yarn is packed close together from course to course, the wales of chain stitches can be spaced relatively far apart.

The fabric may be stretched in the elastomer yarn direction (widthwise) at least 200%, more preferably at least 275%, and has a recovery force in this direction of at least 750 g per cm of fabric length, preferably at least 1000 g per cm, measured at 100% stretch as described in the aforesaid patent application. To achieve this recovery force the elastomer yarn will amount to at least 20,000 denier per cm of fabric length and preferably at least 50,000 denier per cm of fabric length. "Fabric length" in these measurements is, of course, the transverse direction to the direction of the elastomer yarn. The fabric may be stretched lengthwise (during widthwise stretch) no more than 30%, preferably no more than 20%.

The tubular shape of the fabric, which is the shape in which the fabric is used in the dispensing container, can be radially expanding such as shown in FIG. 3, or it can be longitudinally expanding such as shown in FIG. 3 of the aforesaid patent application, depending on the orientation of the fabric when sewn into the tubular shape. The radially expanding embodiment is preferably knit directly on a double needle bed Raschel knitting machine. The resultant flat tubular shape is preferred because of the small volume within the tubular shape when it is in the relaxed state. Longitudinally expanding tubes from fabrics of the present invention can be formed by sewing together the edges of flat fabric(s).

Fabric of the present invention can be considered as an elastic narrow fabric in that generally the width of the fabric (elastomer yarn direction ) is less than 9 cm and more generally less than 6 cm, in the relaxed state.

A series of tubular shaped fabrics was knitted on a half-gauge, 36-gauge, double needle-bed Raschel knitting machine (18-gauge for needles and guides). Nylon yarn was used to make the chain stitches, and spandex yarn was used as the elastomer yarn. No inextensible yarn was laid into the chain stitches. Seven guide bars were used: bars 1, 2, 6, and 7 were threaded with 2240-denier spandex; bar 4 knitting the connecting pattern at the selvedges, was threaded with two ends of 3-ply, 210-denier nylon yarn having a twist of 7 turns per inch "Z", bars 3 and 5 were threaded with one end of the same 3-ply, 210-denier nylon yarn. The tubes were knit on a 9-needle set out (2.54 cm per tube). Guides 1 and 9 of bar 4 are threaded. Guides 2–8 of bars 3 and 5 are fully threaded. Guides 9, 9, 5, and 4 of bars 1, 2, 6, and 7, respectively, are threaded. The chain readings for producing the bar movement patterns are as follows (Raschel knitters' notation):

| | |
|---|---|
| Bar 1 | 0-0 /16-16/36-36/20-20 |
| Bar 2 | 36-36/20-20/ 0-0 /16-16 |
| Bar 3 | 4-0 / 0-0 / 0-4 / 4-4 |
| Bar 4 | 4-0 / 4-0 / 0-4 / 0-4 |

Bar 5 4-4 / 4-0 / 0-0 / 0-4
Bar 6 20-20/ 0-0 /16-16/36-36
Bar 7 16-16/36-36/20-20/ 0-0

The resultant tubular shapes of fabrics were tested for recovery force as specified below, and the results are plotted as curve 30 in FIG. 4 against the relaxed denier of the spandex yarn per centimeter of relaxed fabric. Variation in the denier/centimeter of spandex yarn for this series of fabrics was achieved primarily by varying the number of ends of spandex introduced per course in the fabric, such as by increasing the number of threaded guides in bars 1, 2, 6, and 7.

A similar series of tubular shapes were made except that they additionally contained inextensible yarn laid in the chain stitches by use of two additional guide bars. This additional yarn in some cases was the same as the yarn used above in guide bar 4 to knit the connecting pattern at the selvedges and in other cases was 1000-denier, 192-filament polyester yarn. In all cases the inextensible yarn is introduced by guide bars 3 and 7 on which guides 2–8 are fully threaded. The chain readings for this 9-guide bar arrangement are as follows:

Bar 1 0-0 /16-16/36-36/20-20
Bar 2 36-36/20-20/ 0-0 /16-16
Bar 3 0-0 / 0-0 / 4-4 / 4-4
Bar 4 4-0 /0-0 / 0-4 / 4-4
Bar 5 4-0 / 4-0 / 0-4 / 0-4
Bar 6 4-4 / 4-0 / 0-0 / 0-4
Bar 7 4-4 /0-0 / 0-0 / 0-4
Bar 8 20-20/ 0-0 /16-16/36-36
Bar 9 16-16/36-36/20-20/ 0-0

The results of this series is plotted as curve 32 in FIG. 4 and shows a much more efficient utilization of the recovery force of the spandex yarn by the fabric of the present invention.

The recovery force plotted in the curves of FIG. 4 is expressed as the pressure at 50% discharge exerted by the fabric on an inner plastic bag containing water and placed inside the tubular fabric. The inner bag is filled such that the surrounding fabric is extended 300–335% (increase in circumference). The contents of the bag are discharged in increments beginning one hour after filling, the discharge being done uniformly over a period of 30 minutes. The pressure readings are taken 1½ minutes after each incremental discharge. The value plotted is the pressure so determined after 50% by volume of the contents have been discharged.

As many apparently widely different embodiments of this invention may be made without departing from the spirit and scope thereof, it is to be understood that this invention is not limited to the specific embodiments thereof except as defined in the appended claims.

What is claimed is:

1. A high recovery force warp knit fabric suitable for dispensing application, comprising chain stitches of inelastic yarn, elastomer yarn laid into each course of said chain stitches to provide said fabric with widthwise stretch of at least 200% and recovery force of at least 750 g per cm of fabric length at 100% stretch of said fabric, said elastomer yarn being present in at least 20,000 denier per cm of length of said fabric, and substantially inextensible yarn laid lengthwise in said chain stitches to limit the stretch of said fabric in the direction of said chain stitches upon the stretch of said fabric in the elastomer yarn direction.

2. The warp knit fabric of claim 1 in a tubular shape having one end open and the other end constricted and the stretch of said fabric is in the circumferential direction, whereby said tubular shape is radially expansible.

3. The warp knit fabric of claim 1 wherein said recovery force is at least 1000 g per cm.

4. The warp knit fabric of claim 1 wherein said widthwise stretch is at least 275%.

5. The warp knit fabric of claim 1 wherein said elastomer yarn is present in at least 50,000 denier per cm of length of said fabric.

* * * * *